US005542439A

United States Patent [19]

Gueret

[11] Patent Number: 5,542,439

[45] Date of Patent: Aug. 6, 1996

[54] BRUSH FOR APPLYING A COSMETIC PRODUCT

[75] Inventor: Jean-Louis Gueret, Paris, France

[73] Assignee: L'Oreal, Paris, France

[21] Appl. No.: 366,721

[22] Filed: Dec. 30, 1994

[30] Foreign Application Priority Data

Jan. 14, 1994 [FR] France ..... 94 00360

[51] Int. Cl.[6] ..... A45D 40/26; A46B 11/00; B43K 5/04

[52] U.S. Cl. ..... 132/218; 132/313; 132/317; 132/320; 15/207.2; 15/160; 401/153; 401/122

[58] Field of Search ..... 132/218, 313, 132/317, 320; 15/160, 206, 207.2; 401/153, 129, 122

[56] References Cited

U.S. PATENT DOCUMENTS 4,404,977 9/1983 Vasas ..... 132/218
4,705,053 11/1987 Goncalves ..... 132/218
5,020,551 6/1991 Gueret ..... 132/218
5,370,141 12/1994 Gueret ..... 132/218

*Primary Examiner*—John G. Weiss
*Assistant Examiner*—Philogene Pedro
*Attorney, Agent, or Firm*—Oblon, Spivak, McClelland, Maier, & Neustadt, P.C.

[57] ABSTRACT

A brush for applying cosmetic product comprises an elongate core formed by winding two branches of a metal wire into a helix, with bristles being embedded radially on the core and being clamped between the twisted branches. The brush exhibits at least one face bounded by ridges. The diameter of a section of the brush passes through at least one extremum (maximum or minimum) between the two ends of the brush, and the ridges of the abovementioned face are not straight. The width of the face varies from one end to the other of the brush and passes through at least one extremum (maximum or minimum) between the ends. The brush permits mascara to be applied to eyelashes or dye to be applied to hair.

17 Claims, 3 Drawing Sheets

BRUSH FOR APPLYING A COSMETIC PRODUCT

BACKGROUND OF THE INVENTION

1. Field of the Invention

The present invention relates to a brush for applying a cosmetic product, especially for applying mascara to eyelashes or dye to hair. The brush is of the kind which comprises an elongate core formed by winding two branches of a metal wire into a helix, with bristles being embedded radially in the core and being clamped between the twisted branches. The brush exhibits at least one face bounded by ridges.

2. Discussion of the Background

FR-A-2,605,505 discloses a brush of this type which makes it possible to take up correctly the product to be applied. This product can be found in a container whose outlet, through which the brush passes, is equipped with a wringing member intended to limit the charge of product taken up by the bristles. According to this document, the ridges or edges bounding the face are substantially straight. A brush in accordance with this document makes it possible to achieve relatively different types of make-up, depending on the regions of the brush and of the ridges used and depending on the movement given to the brush; for example, the user may obtain relatively heavy makeup if she does not rotate the brush on itself while applying, and light make-up if she rotates the brush on itself, thus bringing into play the ridges bordering the face.

Although these conventional brushes give satisfactory results, it has become desirable to have available brushes which, on the one hand, make it possible to distribute the product better at the point where it is desired, with the creation of significant variations in wringing on the brush in order to obtain greater ergonomics in making-up and, on the other hand, to use just one type of wringing device and wand diameter while having the possibility of varying the charge on the eyelashes substantially, without fundamentally changing the elegance of the brush.

SUMMARY OF THE INVENTION

An object of the invention is to provide for a brush which is simple and economical to manufacture and practical to use.

According to the present invention, a brush for applying a cosmetic product, of the general sort defined above, is characterized in that the diameter of the section of the brush passes to at least one extremum (maximum or minimum) between the two ends of the brush; and in that the ridges of the abovementioned face are not straight, the width of the face varying from one end of the brush to the other and passing through at least one extremum (maximum or minimum) between the ends.

Thus, the user has available a brush, one face of which is bordered by ridges which are not straight, exhibiting different flexibilities depending on the regions in question; this face furthermore exhibits regions which are more or less heavily laden with product, the whole allowing the user to obtain substantial variations in make-up, depending on the region of the ridges and of the face used for making up.

Preferably, the brush includes, between its two ends, a section of greater diameter.

The face and the ridges of the brush may be obtained by trimming the brush. The trim may be achieved either by cutting, or by grinding.

Before the abovementioned face has been achieved by trimming the brush generally has an axisymmetric shape. Advantageously, the brush has the shape of two coaxial cone frustums stuck together by their large equal-diameter bases.

According to a further embodiment, the brush exhibits a curved lengthwise profile whose distance to the axis of the brush passes through a minimum in a middle region and through a relative maximum between this middle region and each end of the brush.

The abovementioned face of the brush may be flat, or cylindrical, or concave, or outwardly convex, the generatrices of the cylindrical surface being substantially parallel to the axis of the brush.

Preferably, the abovementioned face is tangential or secant to the front end section of the brush.

The trimmed face of the brush may include longitudinal striations, or transverse striations.

The brush may include several such faces trimmed in different planes or different surfaces, in particular substantially parallel to the axis of the brush, two neighboring ones of said faces defining between them, via their non-straight edge, a ridge of variable width, the width of this ridge being a maximum in the regions which are closest, in the radial sense, to the axis of the brush.

The brush may exhibit faces, with different orientations in front of and behind its section of maximum diameter, the front and back faces intersecting, in the region of the maximum section, at a ridge situated in a plane substantially orthogonal to the axis of the brush.

The brush may include a face having a shape with a wavy profile, with generatrices orthogonal to the core of the brush.

The width of the edges or ridges thus defined may be greater than 2 mm. It may range from 0.1 mm to 6 mm, preferably from 1 mm to 4 mm, and more preferably from 1.5 to 3 mm. Furthermore, the edges or ridges may be subjected to trimming or grinding, giving rise to an increase in their width. Grinding furthermore makes it possible to obtain jagged ends of bristles.

Accordingly, the present invention relates to a brush for applying cosmetic product. The brush comprises an elongate core formed by winding two branches of a metal wire into a helix; and bristles embedded radially in the elongate core and clamped between the twisted branches of the helix, the brush comprising at least one face bounded by ridges. A diameter of a section of the brush passes to at least one maximum or minimum extremum between two ends of the brush and the ridges of the face are not straight, such that a width of the face varies from end of the brush, to the other and passes through at least one maximum or minimum extremum between the ends.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
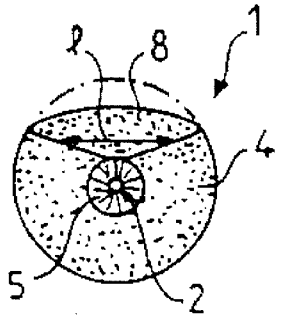
FIG. 3 is a view from the left with respect to FIG. 1.

Referring now to the drawings, wherein like reference numerals designate identical or corresponding parts throughout the several views, and more particularly to FIGS. 1 to 4, a brush 1 can be seen for applying a cosmetic product, especially for applying mascara to the eyelashes, comprising an elongate core 2 formed by winding into a helix two branches of a metal wire 3 which has been bent into a U before the branches were twisted. The core 2 is fixed at the end of a wand t. Bristles 4 are embedded radially between the branches of the wire 3 bent into a U. When the branches of the wire 3 are twisted, the bristles are clamped and held between the helix-shaped turns of the core 2. The core 2 may be central, or off-centered. The bristles 4 may be made of natural or synthetic or flocked fibers; the brush 1 may include a mixture of bristles of different types.

The brush 1 is shaped, particularly by cutting, so that it exhibits a section with dimensions which vary between its two ends 5 and 6. In other words, the radial dimensions of the bristles 4 varies between the ends 5 and 6, from one section to the other.

Figure 1:
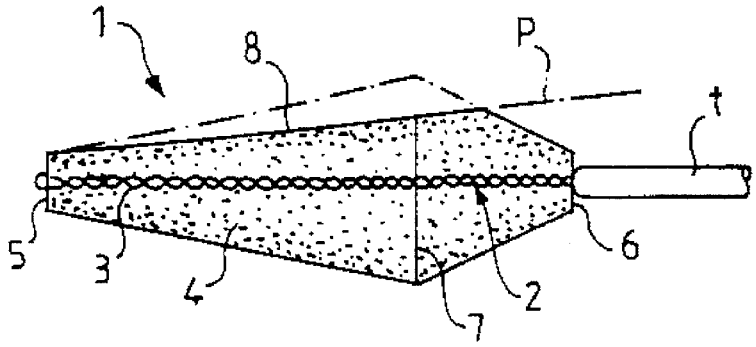
FIG. 1 illustrates a diagrammatic elevation of a brush in accordance with the invention.
Figure 2:
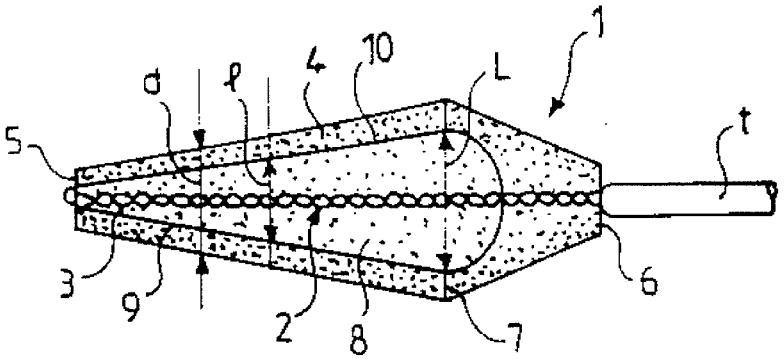
FIG. 2 is a plan view with respect to FIG. 1.

The diameter d (FIG. 2) of the section of the brush passes through at least one extremum, namely, in the example of FIGS. 1 to 3, a maximum situated in a section 7 lying between the two ends 5 and 6. The brush 1 therefore exhibits the shape of two coaxial cone frustums stuck together by the large equal-diameter bases corresponding to the section 7. The front end of the brush has a section 5 which, in the example of FIG. 2, has a smaller diameter than that of the back end 6. These diameters could be equal or the diameter of the section 6 could be smaller than that of the section 5.

The brush 1 exhibits a face 8 bounded by edges 9, 10 situated in a plane P substantially parallel to the axis of the core 2. In the above example, the plane P is slightly inclined with respect to the axis of the core 2. In practice, the angle of inclination of the plane P with respect to the axis of the core 2 is less than 20°.

The face 8 is obtained by trimming the brush 1, that is to say by cutting the bristles 4 of this brush, along the plane P. The face 8 is entirely situated on one and the same side with respect to the core 2 and is therefore not intersected by this core.

In the above example, the edges or ridges 9 and 10 correspond to the intersection of a frustoconical surface with a plane which does not pass through the axis of the surface so that these intersections are made up of segments of cones, not straight.

The width of the face 8, that is to say its dimension 1 in a direction orthogonal to the axis of the core, varies from one longitudinal end to the other of the face 8. This width passes through a maximum L situated in the plane of the section 7 of greatest diameter.

The variable width l, with its extremum (maximum L) situated between the longitudinal ends, makes it possible to modify the making-up substantially, by choosing a part of this face 8 having a certain width, especially by placing oneself in the vicinity of the maximum L.

Advantageously, this face 8 is a tangent, or a secant, to the front end section 5 of the brush.

Figure 4:
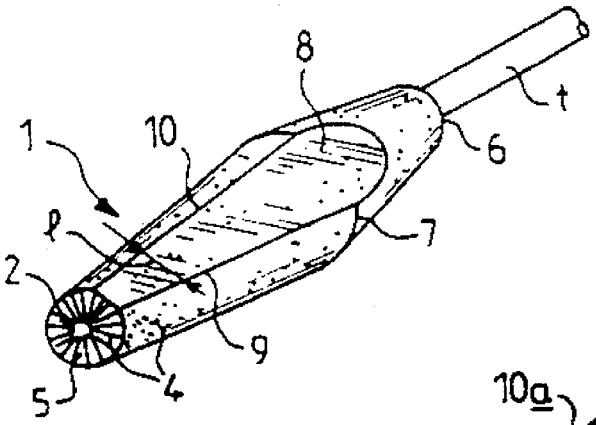
FIG. 4 is a diagrammatic view in perspective of the brush of FIG. 1.

FIG. 4 illustrates diagrammatically, in perspective, the brush of FIGS. 1 to 3.

For the various embodiments which will be described hereafter, the elements which are identical, or which play similar roles, to elements described before, will be denoted by the same numerical references followed by a letter. Their description will not be resumed, or will be given only briefly.

Figure 5:
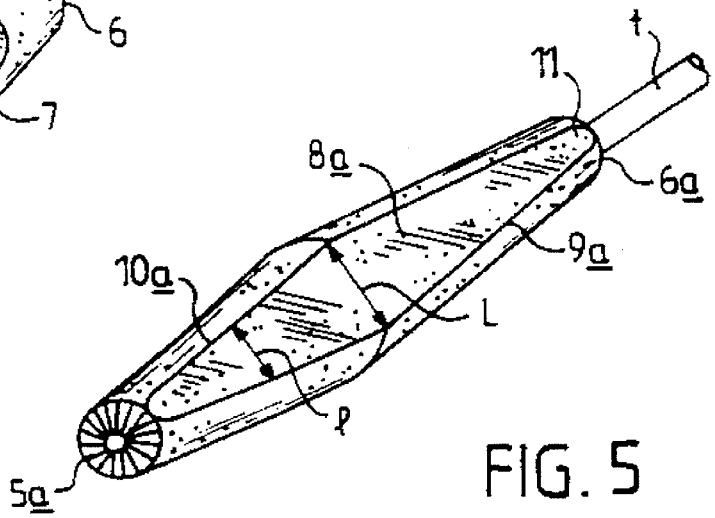
FIGS. 5 to 10 are diagrammatic views in perspective of several embodiments of the brush.

FIG. 5 illustrates a variant according to which the face **8*a* is situated in a plane parallel to the axis of the core so that the back end 11 of the outline is moved to the back section 6*a*** of the brush.

Figure 6:
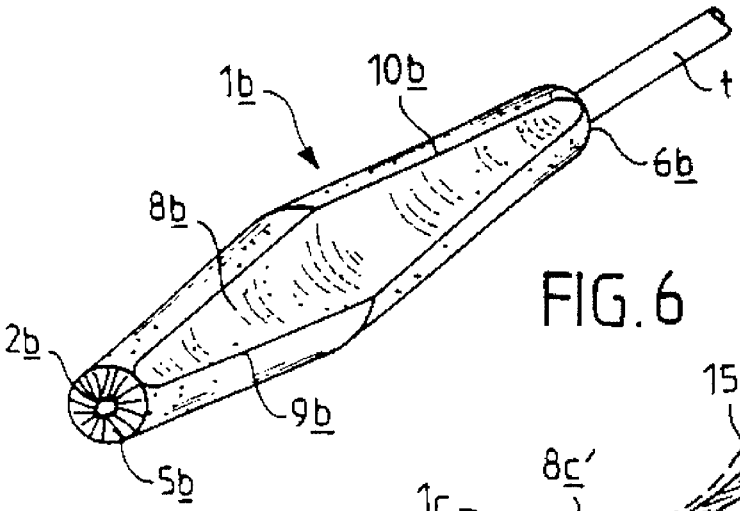

FIG. 6 illustrates a variant of FIG. 5 according to which the face **8*b* is concave cylindrically, the generatrices of the face 8*b* being substantially parallel to the axis of the core 2*b*. The face 8*b* is obtained by trimming a region of the brush 1*b* into a cylindrical surface of axis substantially parallel to the axis of the core 2*b***.

Figure 7:
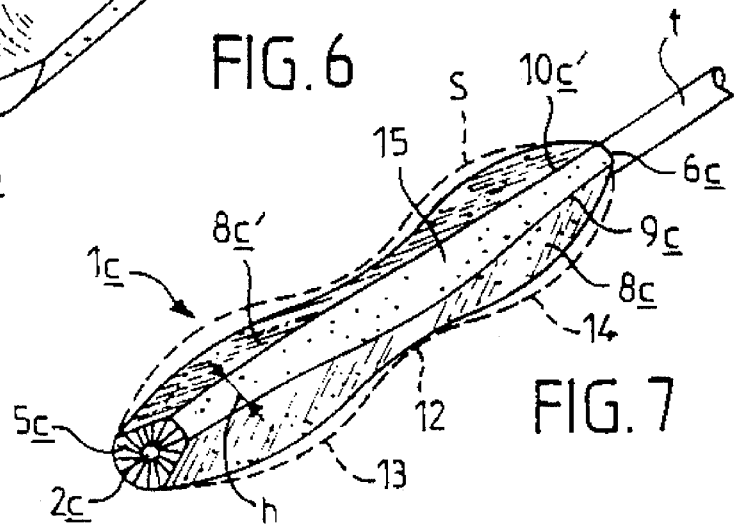

FIG. 7 illustrates, in perspective, a variant in which a blank of the brush **1*c* has an axisymmetric shape with a meridian profile S exhibiting, in its middle region, a part 12 situated at a minimal distance from the axis of the core 2*c* and, between this part 12 and each end 5*c*, 6*c* of the brush, a region 13, 14** situated at a maximum distance relative to the core 2C.

The axisymmetric blank of the brush is then trimmed along two flat faces **8*c*, 8*c*' in two planes parallel to the core 2*c* but not parallel to each other. The planes of the faces 8*c*, 8*c*' intersect beyond the initial surface of revolution of the brush 1*c*, so that a strip 15, forming a ridge, of width h which varies in the longitudinal direction, remains between the non-straight edges 9*c*, 10*c*' closest to each other of the faces 8*c*, 8*c*'. The surface of the strip h is convex. The strip 15 has a relative width which is a minimum at the sections 13, 14 of largest diameter, and a width which is a maximum at the constricted section 12**.

The brush of FIG. 7 makes it clearly possible to vary the making-up by choosing a longitudinal region and involving not only one of the faces **8*c*, 8*c*' and its edges, but also the strip 15**.

Figure 8:
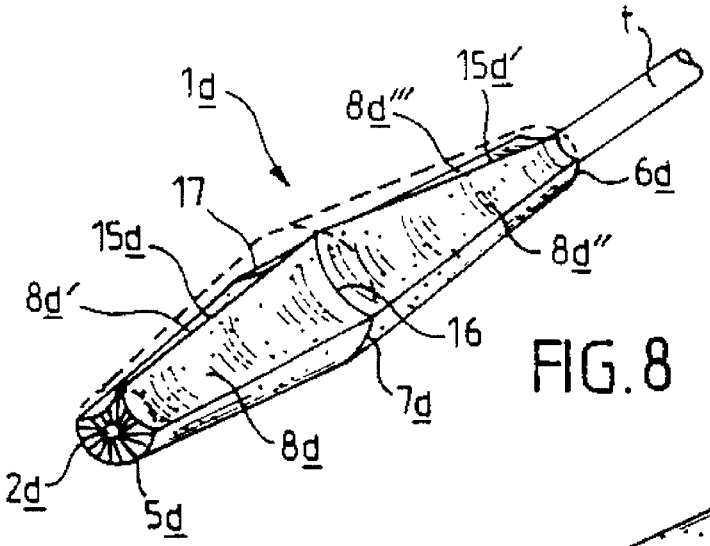

FIG. 8 illustrates a variant **1*d* obtained from a brush blank similar to that of FIGS. 1 to 6**.

The part of the blank of the brush **1*d* situated forward of the section 7*d* of maximum diameter is trimmed along two concave cylindrical faces 8*d*, 8*d*' which intersect the front end 5*d* and the section of maximum diameter 7*d*. The faces 8*d*, 8*d*' which have generatrices which are slightly inclined with respect to the axis of the core 2*d* are located next to each other and their edges closest to one another define a region 15*d*, which is uncut, and the width of which varies in the longitudinal direction of the core 2*d***.

The part of the brush id situated to the rear of the section **7*d* of maximum diameter is cut in a similar way to the front part, but with a slight inclination in the opposite direction so as to exhibit two faces 8***d*", 8*d*"' which are of outwardly concave cylindrical form intersecting the end 6*d*. The neighboring edges of the faces 8*d*" and 8*d*"' define a strip 15*d*' of variable width, which is uncut.

The faces 8*d* and 8*d*" intersect along a sort of curved transverse ridge 16 situated substantially in the plane of the section 7*d*. The same is true for the faces 8*d*' and 8*d*"' which intersect along a curved transverse ridge 17.

Figure 9:
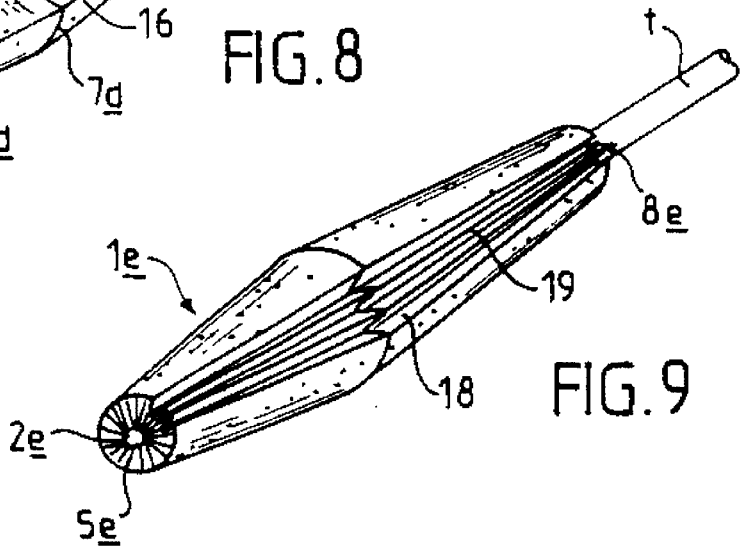

FIG. 9 illustrates a variant of a brush 1*e* obtained, like the brushes of FIGS. 4, 5, 6 and 8, from a blank made up of two coaxial cone frustums stuck together by their large bases. The blank has been cut along two faces such as 8*e* which are diametrically opposed. Longitudinal striations 18 separating sorts of longitudinal ridges 19 have then been made in these faces.

Figure 10:
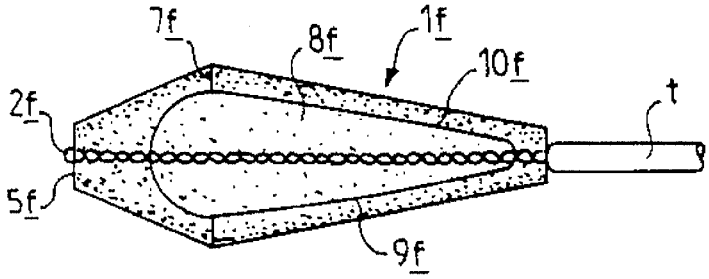

FIG. 10 illustrates a variant of a brush if obtained from a blank also made up of two coaxial cone frustums stuck together by their large common bases. However, the cone frustum situated towards the front of the section of maximum diameter 7*f* exhibits generatrices which, with the axis of the core 2*f*, form an angle greater than the one formed by the generatrices of the cone frustum situated to the rear of this section 7*f*, with the core 2*f*. The blank has been cut into a plane, or substantially plane, face 8*f* parallel to the axis of the core 2*f*, or slightly inclined backwards relative to this core. As a result, the face 8*f* extends substantially towards the rear of the section 7*f* as can be seen in the drawing.

It should be noted that the part of the brush situated forwards of the section of large dimension 7*f* could be not trimmed or ground, only the part situated to the rear of the section of large dimension 7*f* undergoing such a cutting or grinding operation.

Figure 11:
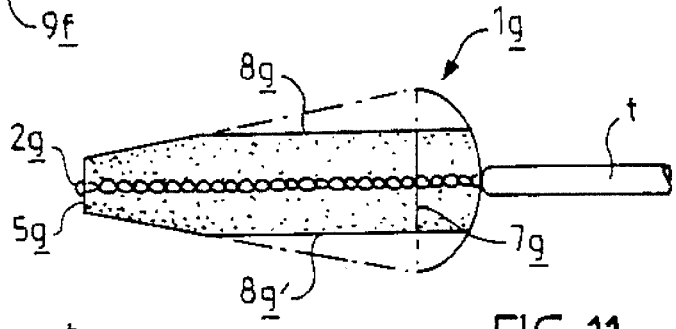
FIG. 11 is an elevation of another embodiment of the brush.
Figure 12:
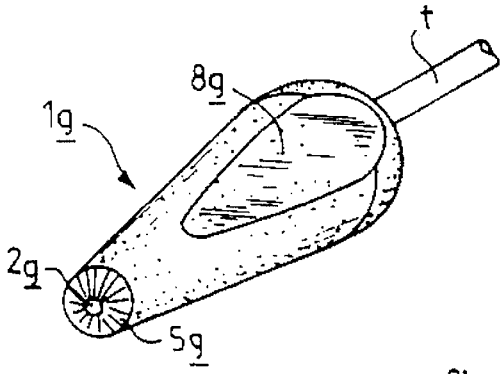
FIG. 12 is a diagrammatic view in perspective of the brush of FIG. 11.

FIGS. 11 and 12 illustrate another variant of the brush 7*g* obtained from a blank from which the part situated forwards of the section 7*g* of maximum diameter has the shape of a relatively sharply tapered cone frustum while the part situated behind the section 7*g* has substantially the shape of a spherical cup, the base of which is coincident with the large base of the cone frustum, in the section 7*g*. The blank is then cut along two mutually parallel planes parallel to the core 2*g* so as to obtain two faces 8*g*, 8*g*' which are parallel.

Figure 13:
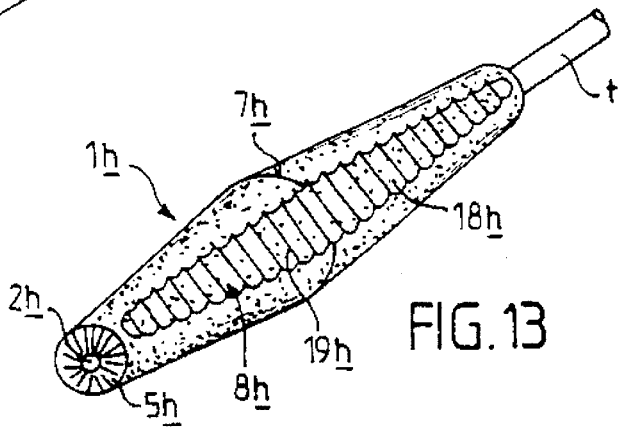
FIG. 13 is a diagrammatic view of another embodiment of the brush, with transverse striations.

FIG. 13 illustrates a variant of a brush 1*h* in which the face 8*h* is striated in the transverse direction, in contrast with the brush of FIG. 9. The striations are denoted by 18*h* and the ridges, separating striations, by 19*h*.

Figure 14:
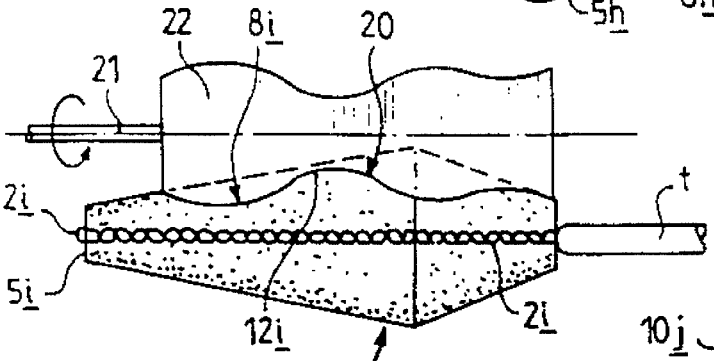
FIG. 14 diagrammatically illustrates, in elevation, the production of a brush with a wavy face.

FIG. 14 shows a brush 1*i* obtained from a blank similar to that of FIGS. 1 and 2 but subjected to a cutting operation carried out laterally and in a wavy shape along the profile 20.

This shaping is obtained with the aid of a grinding wheel 22 which is axisymmetric about its spindle 21. The meridian of the grinding wheel 22 has a profile which matches the profile 20. For trimming using grinding, the brush 1*i* is held stationary while the spindle 21 of the grinding wheel is located parallel to the core 2*i*, this spindle 21 extending on the opposite side from the handle t. The grinding wheel 22 is set into rotation about its spindle 21. Furthermore, the assembly of the spindle 21 and of the grinding wheel 22 is moved in translation in a direction orthogonal to the plane of FIG. 14 and to the core 2*i*.

The face 8*i* of the finished brush has a shape with a wavy profile along the curve 20 of FIG. 14, with generatrices orthogonal to the core 2*i* and to the plane of FIG. 14.

Figure 15:
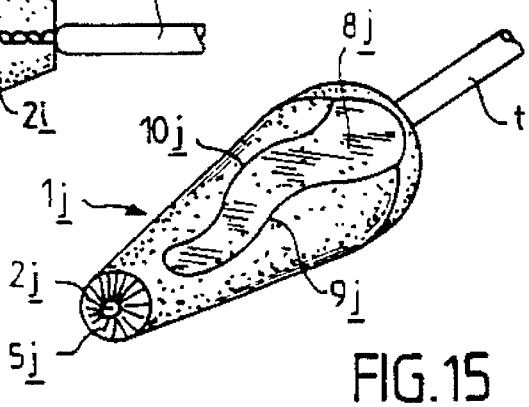
FIG. 15 diagrammatically illustrates, in perspective, another embodiment of the brush.

FIG. 15 illustrates a brush 1*j* of which the substantially flat trimmed face 8*j* exhibits wavy longitudinal edges 9*j*, 10*j*.

From the foregoing examples, it is thus clear that grinding or cutting may be done to a shape. The trimming machines or grinding wheels may have very different profiles.

Trimming may be done on a brush which is not axisymmetric, for example on a brush composed of prism frustums instead of cone frustums. Trimming would then be done in terms of shape on the ridges of the prism frustums.

In all the examples, the edges such as 9, 10 bounding the faces of the brush or the ridges such as 15, 15*d*, 15*d*', 19 formed on this brush may be subjected to grinding so that the width of the edges and ridges (width = dimension in a direction orthogonal to the axis of the core) may be greater than 2 mm.

It is evident that, instead of being flat or concave, the faces such as 8, 8*a*. . . 8*d* could be convex outwards.

In some cases, just the bristles situated on the ridges undergo a treatment to promote the separation of the eyelashes.

The number of bristles per turn of the core 2 is chosen to be from 7 to 50. It may be reduced and especially be less than 50 bristles per turn of the helix: it is then chosen from 10 to 40 bristles, preferably from 15 to 30.

The bristles 4 used for the brushes may be flat bristles, bristles of a curved shape, hollow bristles, cylindrical bristles. The bristles may be made of a thermoplastic, elastic or natural substance. The bristles may exhibit at least one capillary groove.

The brush may be made with a mixture of bristles of different lengths, it being possible for the shortest bristles to be made from a different substance, exhibiting different mechanical properties from those of the long bristles.

The bristles of the brush may be ground so that they are sharply tapered into a fork at their ends; as a variant, the bristles of the brush may exhibit a ball at their ends.

The brush may be produced with a mixture of bristles of different transverse sections. In particular, thick bristles may have a length greater than that of thinner bristles, the latter having balls at their ends.

The winding of the turns of the core 2 of the brush may be carried out by rotating either to the right or to the left about the axis of the core.

The bristles of the brush may be flocked, at least over some of the length of the brush.

A brush according to the invention makes it possible to distribute the product to the point where it is desired, taking account of cylindrical wringing-out, while conserving the ergonomic starting shape; this being in order to vary the charge at the front, the back, or towards the middle of the brush.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A brush for applying cosmetic product, the brush comprising:

an elongate core formed by winding two branches of a metal wire into a helix; and bristles embedded radially in said elongate core and clamped between the twisted branches of the helix, the brush comprising at least one face bounded by ridges;

wherein:

a diameter of a section of the brush passes to at least one extremum between two ends of the brush; and the ridges of the face are not straight, a width of the face varying from one end of the brush to the other and passing through at least one extremum between said ends.

2. A brush according to claim 1, further comprising a section of greater diameter between said two ends.

3. A brush according to claim 2, wherein the brush has the shape of two coaxial cone frustums stuck together by their large equal-diameter bases.

4. A brush according to claim 1, wherein the brush comprises a curved lengthwise profile having a distance to an axis of the brush which passes through a minimum in a middle region and through a relative maximum between the middle region and each end of the brush.

5. A brush according to claim 1, wherein the face of the brush is flat.

6. A brush according to claim 1, wherein the face is concave cylindrical, and generatrices of a cylindrical surface of the face is substantially parallel to an axis of the brush.

7. A brush according to claim 1, wherein the face is a tangent, to a front end section of the brush.

8. A brush according to claim 1, wherein the face of the brush includes longitudinal striations.

9. A brush according to claim 1, further comprising several faces in different planes, substantially parallel to an axis of the brush, two neighboring faces defining between them, via their non-straight edge, a ridge of variable width, a width of said ridge being a maximum in regions which are radially closest to the axis of the brush.

10. A brush according to claim 1, further comprising faces with different orientations in front of and behind a section of maximum diameter of the brush, front and back faces intersecting in a region of maximum section, at a ridge situated in a plane substantially orthogonal to an axis of the brush.

11. A brush according to claim 1, wherein the face has a shape with a wavy profile, with generatrices orthogonal to the core of the brush.

12. A brush according to claim 1, wherein a width of the ridges is greater than 2 mm.

13. A brush according to claim 1, wherein the brush is a mascara brush.

14. A brush according to claim 1, wherein the face is outwardly convex, and generatrices of a cylindrical surface of the face is substantially parallel to an axis of the brush.

15. A brush according to claim 1, wherein the face is a secant to a front end section of the brush.

16. A brush according to claim 1, wherein the face of the brush includes transverse striations.

17. A brush according to claim 1, further comprising several faces in different surfaces, substantially parallel to an axis of the brush, two neighboring faces defining between them, via their non-straight edge, a ridge of variable width, a width of said ridge being a maximum in regions which are radially closest to the axis of the brush.

* * * * *